US007278670B2

(12) United States Patent
Galletta

(10) Patent No.: US 7,278,670 B2
(45) Date of Patent: Oct. 9, 2007

(54) LIFTING SPREADER FOR HELICOPTER

(75) Inventor: Stephen Brian Galletta, Savannah, GA (US)

(73) Assignee: RTC, Inc., Savannah, GA (US)

( * ) Notice: Subject to any disclaimer, the term of this patent is extended or adjusted under 35 U.S.C. 154(b) by 0 days.

(21) Appl. No.: 11/118,351

(22) Filed: May 2, 2005

(65) Prior Publication Data

US 2005/0242600 A1 Nov. 3, 2005

Related U.S. Application Data

(60) Provisional application No. 60/566,435, filed on Apr. 30, 2004.

(51) Int. Cl.
*B66C 1/12* (2006.01)

(52) U.S. Cl. ..... 294/81.5; 294/81.1; 294/74

(58) Field of Classification Search ..... 294/81.1, 294/81.5, 81.56, 74, 67.3, 67.4, 67.1
See application file for complete search history.

(56) References Cited

U.S. PATENT DOCUMENTS

| | | | | |
|---|---|---|---|---|
| 3,210,114 | A * | 10/1965 | Lawton | 294/81.4 |
| 3,602,544 | A * | 8/1971 | Marsh | 294/74 |
| 4,397,493 | A * | 8/1983 | Khachaturian et al. | 294/81.1 |
| 4,549,759 | A * | 10/1985 | Fowler, Jr. | 294/67.2 |
| 4,973,795 | A * | 11/1990 | Sharpe | 174/40 R |
| 5,603,544 | A * | 2/1997 | Bishop et al. | 294/81.1 |
| 6,729,666 | B2 * | 5/2004 | Mullis | 294/81.56 |

* cited by examiner

*Primary Examiner*—Dean J Kramer
(74) *Attorney, Agent, or Firm*—Birch, Stewart, Kolasch & Birch, LLP

(57) ABSTRACT

A lifting spreader for an irregular object such as a helicopter. In order to adapt a standard container frame to lift an irregular object, a pair of spreader bars containing slings is provided. Each bar has a central pipe welded to a container box at each end. An L-shaped padeye having a hole in an outer corner is welded to each box and an end stand is welded transversely to the padeye for stability. An extra thickness of material is mounted on either side of the padeye around the hole to provide extra strength where the sling and shackle arrangement is hooked to the spreader bar.

5 Claims, 3 Drawing Sheets

LIFTING SPREADER FOR HELICOPTER

BACKGROUND OF THE INVENTION

1. Field of the Invention

The present invention relates to a lifting spreader and more particularly to a lifting spreader for a helicopter.

2. Description of the Prior Art

A great deal of shipping has been converted to containerized arrangements which allow for quicker loading and unloading of ships and other forms of transportation. This container can be quite large and accordingly, it is easy to ship great numbers of small items in a single package. This can be easily removed from the ship and placed on a truck or train using a crane rigged to connect the sling with a container frame. However, there are many items that are large and not suitable for storing in containers. One example is a helicopter which must be shipped long distances as part of a military operation or merely as part of an original overseas sale. While it is possible to jury-rig a traditional container frame using various cables etc., in order to lift a helicopter, it requires additional weight in the extra cabling and extra time to prepare the rigging.

SUMMARY OF THE INVENTION

Accordingly, one object of the present invention, is to provide a lifting spreader which is used for lifting a large, heavy, irregularly shaped item such as a helicopter. Briefly, this is achieved by providing a pair of spreader bars each being made from a pipe with a container box mounted on each end and with a padeye connected thereto for receiving a shackle and sling arrangement at each end.

DESCRIPTION OF THE PREFERRED EMBODIMENT

The helicopter is normally provided with eye bolts or other arrangements for lifting. For example the Boeing CH-47 helicopter has two eye bolts in different locations. Thus, it is preferable to provide a spreader bar for each of the eye bolts to stabilize the load for lifting.

Each spreader bar 10 (FIGS. 1A-1D) is formed from a pipe 12 which may be on the order of 7 feet long. At each end of the pipe, a box 14 is welded. The box is a standard box used in containerized shipping and normally mounted on the corners of the containers.

Figure 4:
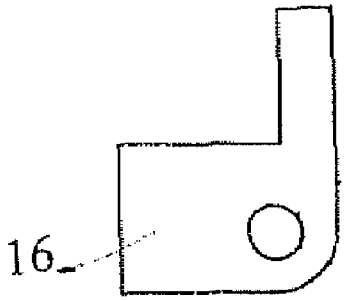
FIG. 4 is a front view of a padeye of the lifting spreader of FIG. 1.

An L-shaped padeye 16 (FIG. 4) is welded to each box 14 with the vertical part of the L being mounted along the inside face of the box. The inside face is the face which is connected to the pipe. The horizontal part of the L extends under the box and is welded thereto. In order for the pipe to fit over the vertical part of the L, notches 13 are made of a size to receive this vertical part of the L.

Figure 3:
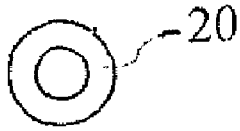
FIG. 3 is a front view of a doubler used in the lifting spreader of FIG. 1.

Near the corner of the padeye, an opening 18 is made, for example 1¾ inches in diameter which receives a shackle of the sling arrangement A doubler piece 20 (FIG. 3) is mounted on either side of the padeye which is circular in arrangement and which has a circular opening of the same size as the opening in the padeye. Thus the doubler increases the thickness of the padeye plate around the hole for reinforcement. Thus, when the shackle is attached to the hole, the thickness around the hole is double the thickness of the rest of the padeye, if the doubler plate material is half of the thickness of the plate material of the padeye itself.

Figure 1A:
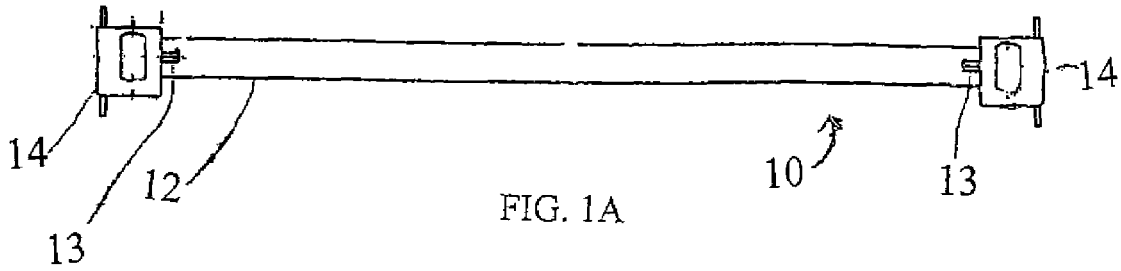
FIG. 1*a* is a top view of the lifting spreader according to the present invention.
Figure 1B:
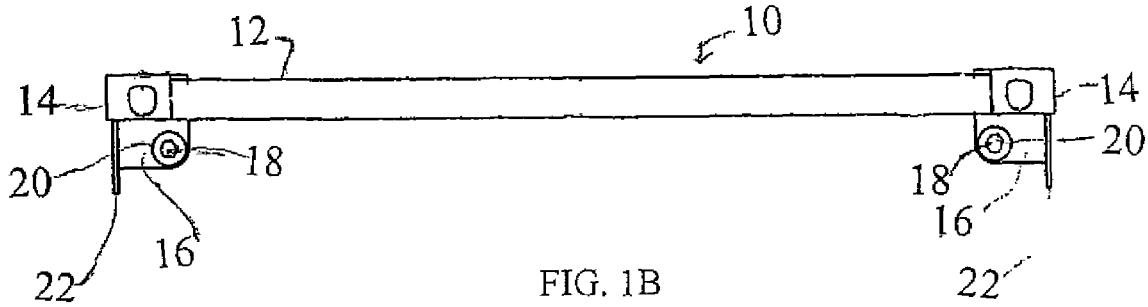
FIG. 1B is a side view of the lifting spreader according to the present invention.
Figure 1C:
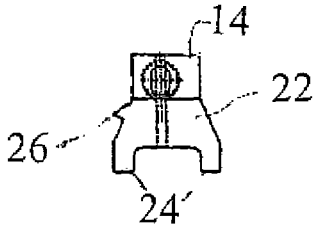
FIG. 1C is an end view of the lifting spreader according to the present invention.
Figure 1D:
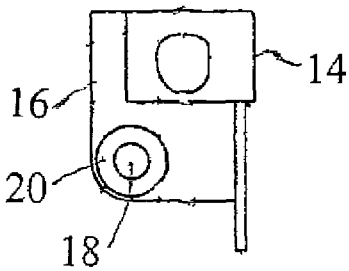
FIG. 1D is a corner detail of the lifting spreader according to the present invention.
Figure 2:
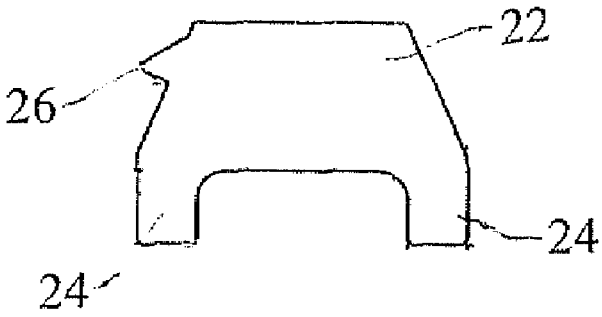
FIG. 2 is a front view of the end stand used in the lifting spreader in FIG. 1.

An end stand 22 (FIG. 2) is mounted below each box. The top of the end stand is of a similar dimension to the width of the box. The end stand is usually in the shape of a trapezoid with two legs 24 depending from the bottom edge. The legs are safety features for ergonomic reasons. The height of the trapezoid is approximately equal to the height of the horizontal portion of the padeye and is mounted adjacent thereto for welding. The end stand acts as a stiffner for the padeye in the lateral direction. An "arrow" or pointed projection 26 extends from one of the inclined walls of the trapezoid. This arrow is for directional purposes and points away from the end of the box with an opening.

The end stand, padeye and doubler parts are all made from plate material such as ½ inch or 1 inch steel plate. For example, the padeye may be made of 1-inch material while the doubler and end stand are made of ½ inch material each. The arrangement of the end stand, padeye and doubler is designed to provide a hooking arrangement for receiving the slings and shackles which connect the helicopter eye bolt to the spreader bar.

Figure 5:
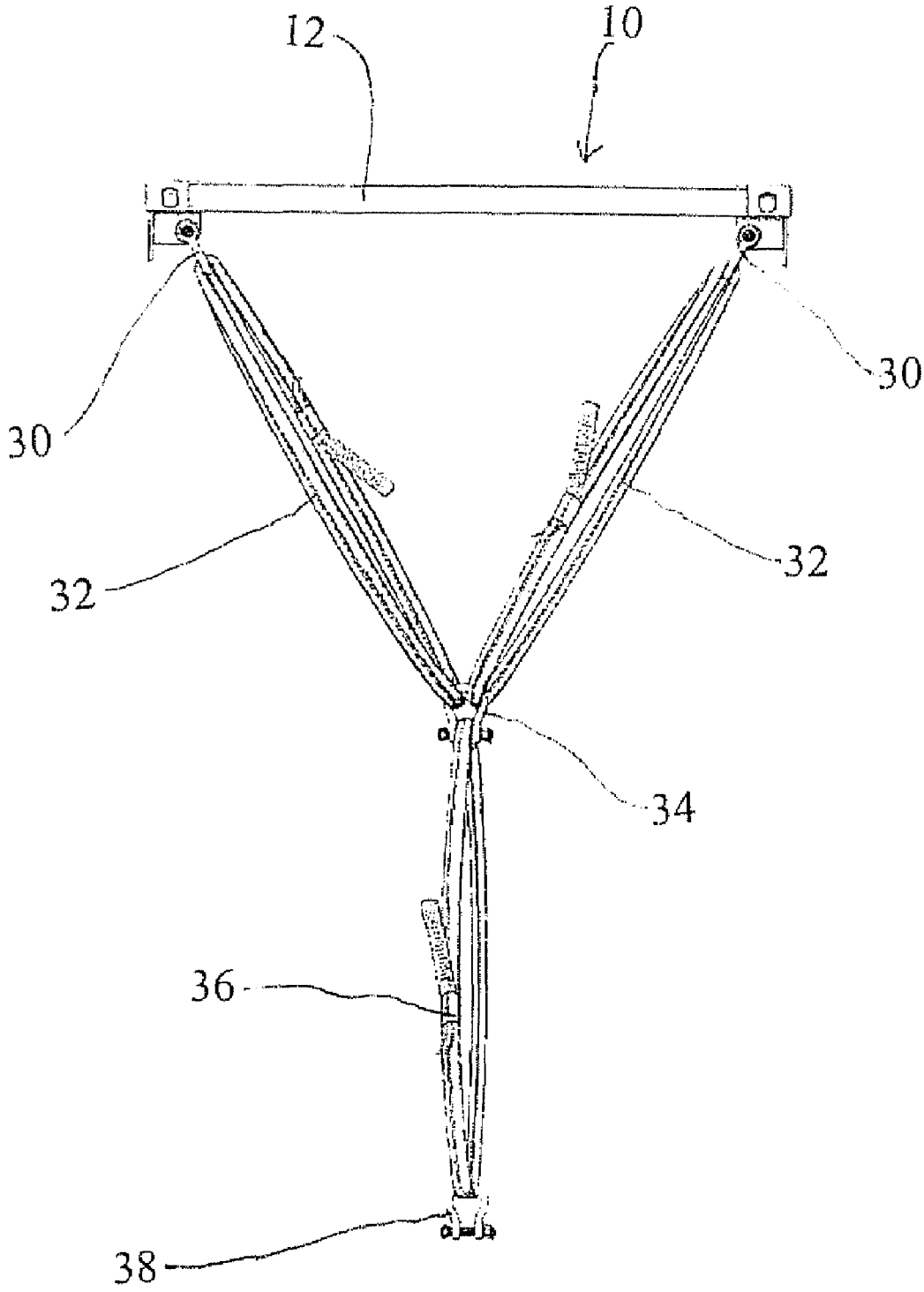
FIG. 5 is a perspective view of a rigging assembly using the lifting spreader of FIG. 1.

A shackle 30 is placed through each hole in the doubler and padeye. A sling in the form of a loop 32 may be placed within the shackle. The two loops on opposite ends of the spreader bar are then shackled 34 together at their lower end. A single sling 36 loop then extends downwardly and ends in another shackle 38 which hooks to the eye bolt of the helicopter (FIG. 5).

The various slings may be made of synthetic fiber material having sufficient strength in comparison to the weight of the helicopter. However, other materials such as steel could be used if desired. Likewise, other hooking arrangements other than shackles can be utilized if desired. Thus, for a single helicopter, it is desirable to use two spreader bars, with each spreader bar utilizing 3 slings and 4 shackles. The exact length and weight capacity of the slings at opposite ends need not be the same, but may be adjusted for the weight distribution and dimensions of the helicopter.

As one example, it is possible that the spreader bars have a capacity of 20,000 pounds each. Each shackle has a capacity of 27,000 pounds. Each upper sling may have a capacity of 15,000 pounds and each lower sling may have a capacity of 20,000 pounds. These capacities would be appropriate for a Boeing CH-47 helicopter, however other capacities and lengths may be used for other helicopters or other objects. It should be remembered that the upper slings should all be of the same length, but the lower slings may differ from each other depending on the dimensions of the helicopter. Thus the upper slings may be 8 feet in length while one of the lower slings may be 4 feet and the other 7 feet. Other dimensions are also possible.

Accordingly, by utilizing this arrangement of the lifting spreader, it is possible for a crane having a standard container frame arrangement to easily hook into a pair of spreader bars according to the present invention and be latched thereto in a standard fashion for container lifting. The slings may then be easily attached to the eye bolts of the helicopter in a standard fashion. The helicopter may then be lifted in a safe and easy fashion for quick removal from the ship or other vehicle. Thus, the present invention allows a standard crane used for lifting containers to easily be modified for lifting irregular objects such as helicopters. The result is a strong, simple, inexpensive arrangement for easily and quickly moving irregular objects.

Various additional modifications and verifications of the present invention are possible in light of the above teachings. It is therefore to be understood that within the scope of the appended claims, the invention may be practiced otherwise than as specifically described herein.

What is claimed:

1. A spreader bar comprising:

a central pipe;

a pair of container boxes for connecting to a container frame, each mounted on opposite ends of said pipe;

an L-shaped padeye for mounting on each of said boxes, said padeye extending along the bottom and one side of the corresponding box, said padeye including an opening; and an end stand having a pointed projection and descending legs mounted to the bottom of each box and in contact with said padeye for providing lateral stability.

2. The spreader bar according to claim 1, wherein doublers are placed on either side of said opening for the strengthening of said padeye.

3. The spreader bar according to claim 1, wherein a sling is attached to each opening with slings from opposite ends being connected together.

4. The spreader bar according to claim 3, wherein an additional sling extends downwardly from the connection of said slings.

5. A spreader bar comprising:

a central pipe;

a pair of container boxes for connecting to a container frame, each mounted on opposite ends of said pipe;

an L-shaped padeye for mounting on each of said boxes, said padeye extending along the bottom and one side of the corresponding box, said padeye including an opening; and an end stand having descending legs mounted to the bottom of each box and in contact with said padeye for providing lateral stability, wherein said pipe includes notches to receive said L-shaped padeye.

* * * * *